US012038184B2

(12) United States Patent
Chaba

(10) Patent No.: US 12,038,184 B2
(45) Date of Patent: Jul. 16, 2024

(54) OUTDOOR UNIT FOR AIR-CONDITIONING APPARATUS

(71) Applicant: MITSUBISHI ELECTRIC CONSUMER PRODUCTS (THAILAND) CO., LTD., Chonburi (TH)

(72) Inventor: Waranyu Chaba, Amata (TH)

(73) Assignee: MITSUBISHI ELECTRIC CONSUMER PRODUCTS (THAILAND) CO., LTD., Chonburi (TH)

( * ) Notice: Subject to any disclaimer, the term of this patent is extended or adjusted under 35 U.S.C. 154(b) by 254 days.

(21) Appl. No.: 17/789,624

(22) PCT Filed: Jan. 14, 2020

(86) PCT No.: PCT/TH2020/000001
§ 371 (c)(1),
(2) Date: Jun. 28, 2022

(87) PCT Pub. No.: WO2021/145829
PCT Pub. Date: Jul. 22, 2021

(65) Prior Publication Data

US 2023/0052303 A1 Feb. 16, 2023

(51) Int. Cl.
*F24F 1/16* (2011.01)
*F24F 13/20* (2006.01)
*F24F 13/30* (2006.01)

(52) U.S. Cl.
CPC ..... *F24F 1/16* (2013.01); *F24F 13/20* (2013.01); *F24F 13/30* (2013.01)

(58) Field of Classification Search
CPC ..... F24F 1/14; F24F 1/16; F24F 1/18; F24F 13/30
See application file for complete search history.

(56) References Cited

FOREIGN PATENT DOCUMENTS

JP H1096541 A * 4/1998

* cited by examiner

*Primary Examiner* — Eric S Ruppert
(74) *Attorney, Agent, or Firm* — Posz Law Group, PLC

(57) ABSTRACT

The present invention discloses an outdoor unit 100 for an air-conditioning apparatus, comprising: a bottom plate made of metal; a heat exchanger made of metal that is different from metal of the bottom plate, which includes a front surface portion, a corner portion and a side surface portion, and which is formed in an L-shape when viewed from; and an upper support which continuously covers the front surface portion, the corner portion and the side surface portion when viewed from above.

8 Claims, 10 Drawing Sheets

OUTDOOR UNIT FOR AIR-CONDITIONING APPARATUS

CROSS REFERENCE TO RELATED APPLICATION

This application is a U.S. national stage application of PCT/TH2020/000001 filed on Jan. 14, 2020, the contents of which are incorporated herein by reference.

FIELD OF INVENTION

The present invention relates to an outdoor unit for an air-conditioning apparatus.

BACKGROUND OF THE INVENTION

It is known that the outdoor unit for an air-conditioning apparatus has a heat exchanger, which includes a front surface portion, a corner portion bent from one end of the front surface portion toward the front side and a side surface portion extending further toward the front side from the corner portion, and which is formed in an L-shape when viewed from above, and an upper support which covers the front surface portion when viewed from above, as disclosed in Japanese laid-open publication No. JP2014-137155A (PTL1).

In the prior art, as the heat exchanger, corrugated fins type heat exchanger which has rigidity lower than that of a fin-and-tube type heat exchanger is disclosed. If the heat exchangers disclosed in the prior art are stacked up, a perpendicular downward load generated by the stacked heat exchangers on the upper support, is applied on the upper support. As such, there is a possibility that the heat exchanger is locally deformed by the perpendicular downward load.

Moreover, in an outdoor unit of an air-conditioning apparatus, a metal material such as iron powder or copper powder may cling to the heat exchanger. If the iron powder and the copper powder clings to the heat exchanger, there are cases when the electrolytic corrosion of the heat exchanger occurs due to the rainwater and the drain water which flow into the heat exchanger.

Therefore, the development of the outdoor unit for an air-conditioning apparatus capable to prevent the heat exchanger from being locally deformed by the perpendicular downward load which is applied on the upper support in case that the heat exchangers are stacked up, as well as to prevent the electrolytic corrosion in the heat exchanger, is required.

CITATION LIST

Patent Literature

PTL 1: Japanese laid-open publication No.: JP2014-137155A

SUMMARY OF THE INVENTION

The objective of the present invention is to provide an outdoor unit for an air-conditioning apparatus which is capable to prevent the heat exchanger from being locally deformed by the perpendicular downward load which is applied on the upper support in case that the heat exchangers are stacked up, as well as to prevent the electrolytic corrosion in the heat exchanger.

In order to achieve the above objective, an embodiment of the present invention provides an outdoor unit for an air-conditioning apparatus, comprising: a bottom plate made of metal; a heat exchanger made of metal that is different from metal of the bottom plate, which includes a front surface portion, a corner portion bent from one end of the front surface portion toward the front side and a side surface portion extending further toward the front side from the corner portion, and which is formed in an L-shape when viewed from above so that a length in the longitudinal direction of the front surface portion is made longer than that of the side surface portion when viewed from above, and which is installed on the bottom plate so that surfaces of the front surface portion, the corner portion and the side surface portion, into which air flows, face outward; and an upper support which continuously covers the front surface portion, the corner portion and the side surface portion when viewed from above, which includes a groove opening downward so that a top portion of the heat exchanger fits to the groove of the upper support.

According to the embodiment of the present invention, firstly, since the upper support which continuously covers the front surface portion, the corner portion and the side surface portion when viewed from above, the upper support functions as the cover which is formed to cover the top of the heat exchanger. As such, even if the rainwater and/or the drain water flows into the heat exchanger, it is possible to reduce the opportunities to bring the rainwater and/or the drain water into contact with the heat exchanger. Therefore, it is possible to prevent the electrolytic corrosion in the heat exchanger.

Secondly, an upper support which continuously covers the front surface portion, the corner portion and the side surface portion when viewed from above, even if the heat exchangers are stacked up and thereby the perpendicular downward load generated by the stacked heat exchangers on the upper support, is applied on the upper support, the load can be distributed on the whole upper support which is positioned on the top of the front surface portion, the corner portion and the side surface portion. As such, the upper support can bear a heavy load.

As a result, it is possible to prevent the heat exchanger from being locally deformed by the perpendicular downward load which is applied on the upper support in case that the heat exchangers are stacked up.

Finally, since the upper support includes a groove opening downward so that a top portion of the heat exchanger fits to the groove of the upper support, the upper support can be easily attached on the heat exchanger.

Therefore, according to the embodiment of the present invention, it is possible to prevent the heat exchanger from being locally deformed by the perpendicular downward load which is applied on the upper support in case that the heat exchangers are stacked up, as well as to prevent the electrolytic corrosion in the heat exchanger.

BRIEF DESCRIPTION OF DRAWINGS

The principle of the present invention and its advantages will become apparent in the following description taking in consideration with the accompanying drawings in which.

DETAILED DESCRIPTION OF EMBODIMENTS OF THE INVENTION

Hereinafter, the outdoor unit for an air-conditioning apparatus according to embodiments of the invention will be described with reference to the drawings and the like.

Figure 1:
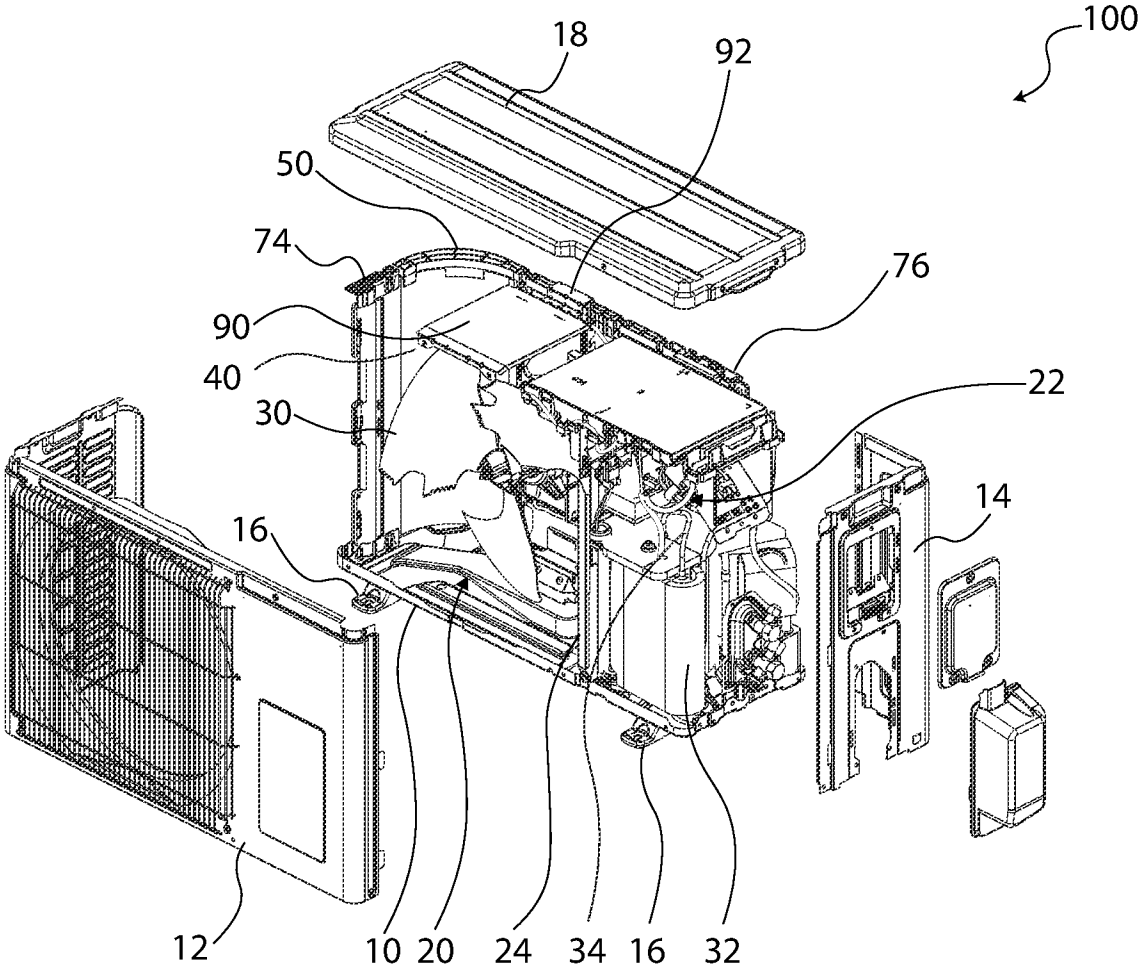
FIG. 1 is an exploded view of an outdoor unit for an air-conditioning apparatus according to the embodiment of this invention.

FIG. 1 is an exploded view of an outdoor unit 100 (hereinafter referred to as outdoor unit 100) for an air-conditioning apparatus according to the embodiment. This outdoor unit 100 is installed outdoors and is connected to an indoor unit installed indoors (not shown) by refrigerant pipes 34 including one refrigerant pipe which liquid refrigerant flows and the other refrigerant pipe in which gas refrigerant flows, thereby constructing a refrigeration cycle.

The outdoor unit 100 includes a bottom plate 10 having legs 16, 16, a heat exchanger 40 such as a parallel flow type heat exchanger, which is installed on the bottom plate 10 with its rear surface facing outward, a front panel 12 disposed opposite the back surface of the heat exchanger 40, side panel 14, and a top plate 18, and is formed in a box shape. In the parallel flow type heat exchanger, an inflow side of air is the rear surface of the outdoor unit 100, and an outflow side of air is the front surface.

The inside of the outdoor unit 100 is divided into a blower chamber 20 and a machine chamber 22 by a separator 24 which is provided between the surface of the heat exchanger 40 and the front panel 12. A fan motor 26 installed in front of the heat exchanger 40 is provided in the blower chamber 20. A propeller fan 30 is mounted on the fan motor 26. In the machine chamber 22, a compressor 32 which is disposed on a bottom plate 10, refrigerant pipes 34, an electric device (not shown) and the like are disposed. The bottom plate 10 is made by, for example, a thin steel plate having conductivity.

The heat exchanger 40 includes a front surface portion 42, a corner portion 44 bent from a left end of the front surface portion 42 toward the front side, and a side surface portion 46 extending further toward the front side from the corner portion 44. Namely, the heat exchanger 40 is formed in an L-shape when viewed from above so that a length in the longitudinal direction of the front surface portion 42 is made longer than that of the side surface portion 46 when viewed from above. The heat exchanger 40 is installed on the bottom plate 10 so that surfaces of the front surface portion 42, the corner portion 44 and the side surface portion 46, into which air flows, face outward.

Header pipes are provided at both ends of the heat exchanger 40, and a plurality of flat tubes are arranged in parallel between the header pipes, and corrugated fins are arranged between the flat tubes. The header pipe, the flat tube and the corrugated fin are made of aluminum (or aluminum alloy). The header pipe and the flat tube, as well as the flat tube and the corrugated fin are fixed to each other by brazing or welding. The header pipe on the machine chamber side is connected to the compressor 32 via the refrigerant pipe 34. The heat exchanger 40 of the outdoor unit 100 acts as a condenser during a cooling operation.

Figure 2:
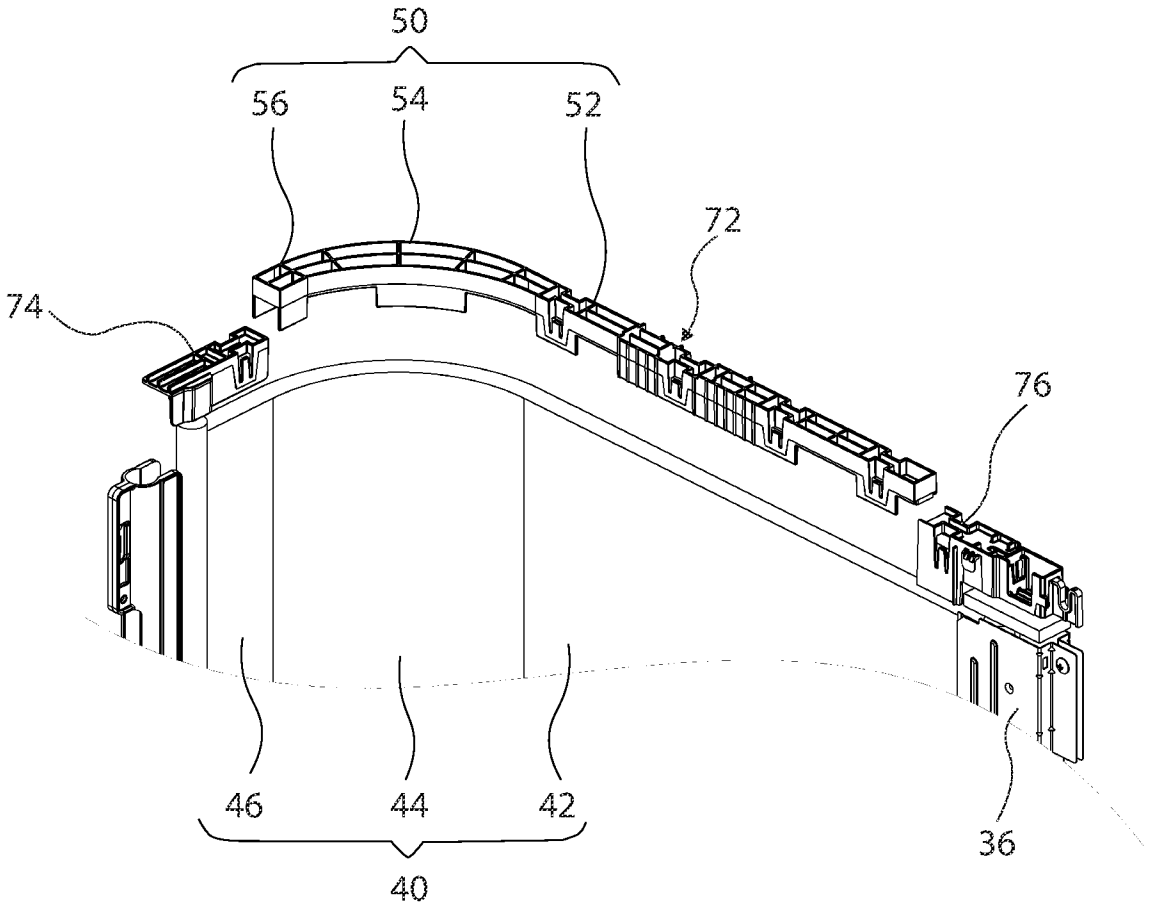
FIG. 2 is an explanatory view of the upper support 50 without a fan motor support, illustrated in FIG. 1.
Figure 3:
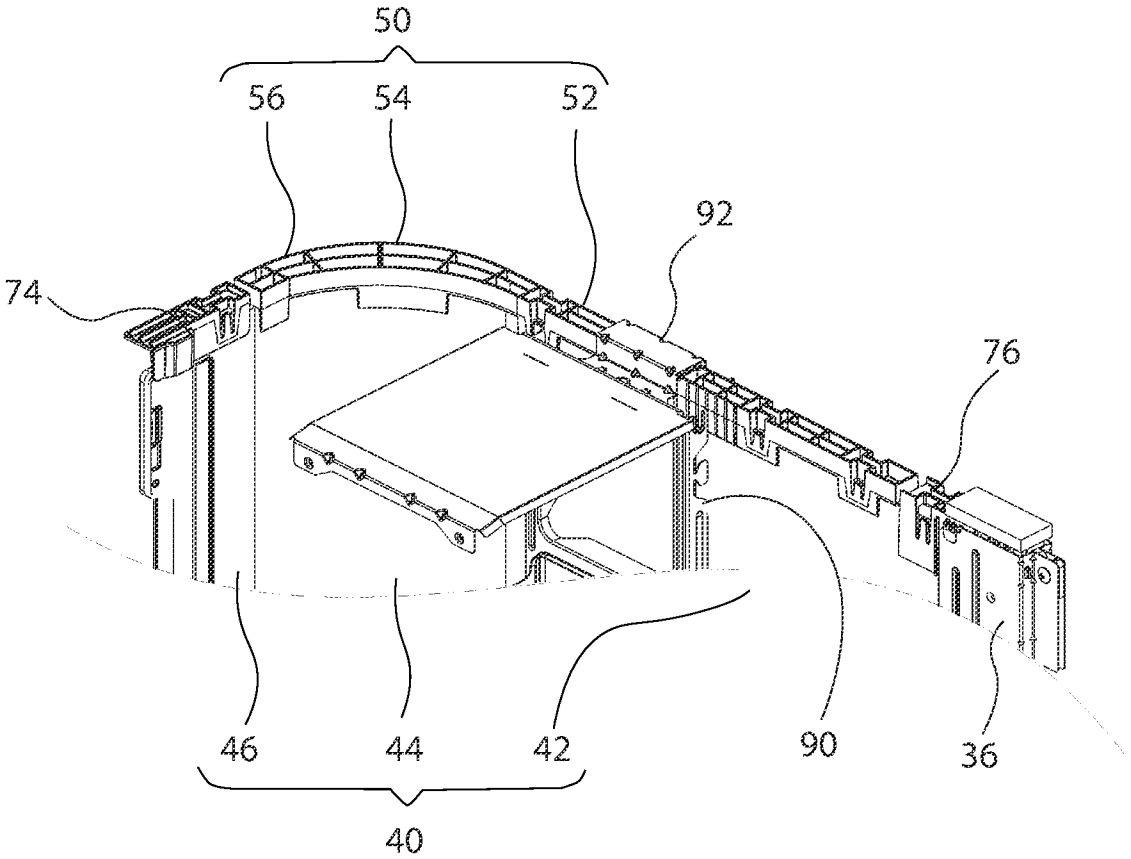
FIG. 3 is an explanatory view of the upper support 50 with the fan motor support, illustrated in FIG. 1.

As shown in FIG. 1 to FIG. 3, a first end upper support 74, an upper support 50 and a second end upper support 76 are attached to the top of the heat exchanger 40. The first end upper support 74, the upper support 50 and the second end upper support 76 are made of synthetic resin. The first end upper support 74 is attached to the heat exchanger 40 so as to cover the end of the side surface portion 46 of the heat exchanger 40 when viewed from above. The second end upper support 76 is attached to the heat exchanger 40 so as to cover the end of the front surface portion 42 of the heat exchanger 40 when viewed from above. The upper support 50 is attached to the heat exchanger 40 so as to continuously cover the front surface portion 42, the corner portion 44 and the side surface portion 46 when viewed from above.

Figure 4:
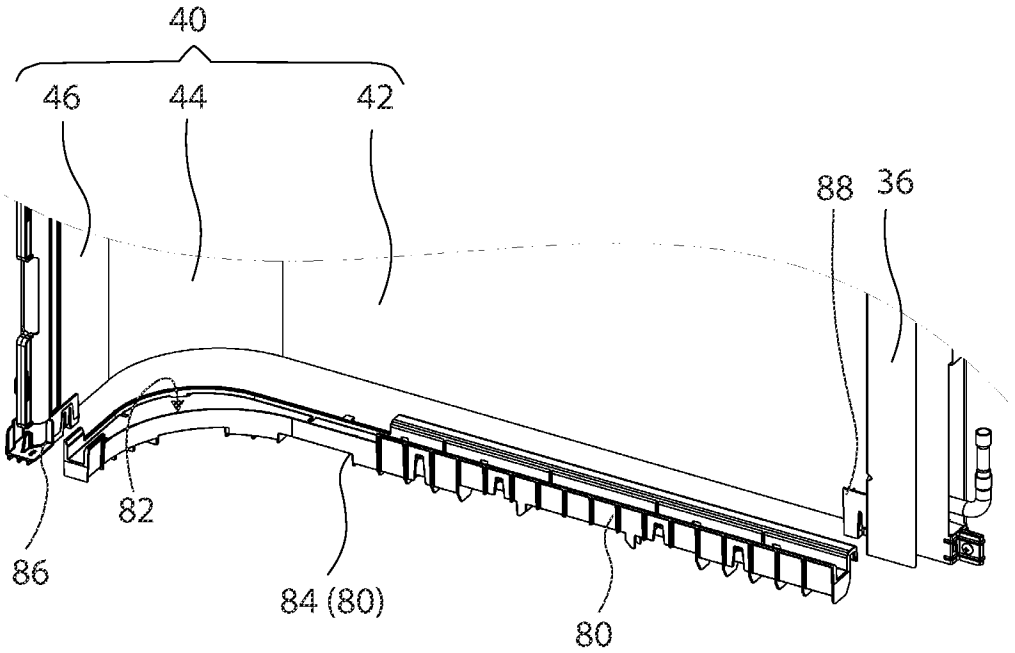
FIG. 4 is an explanatory view of the lower support 80 without the fan motor support, illustrated in FIG. 1.
Figure 5:
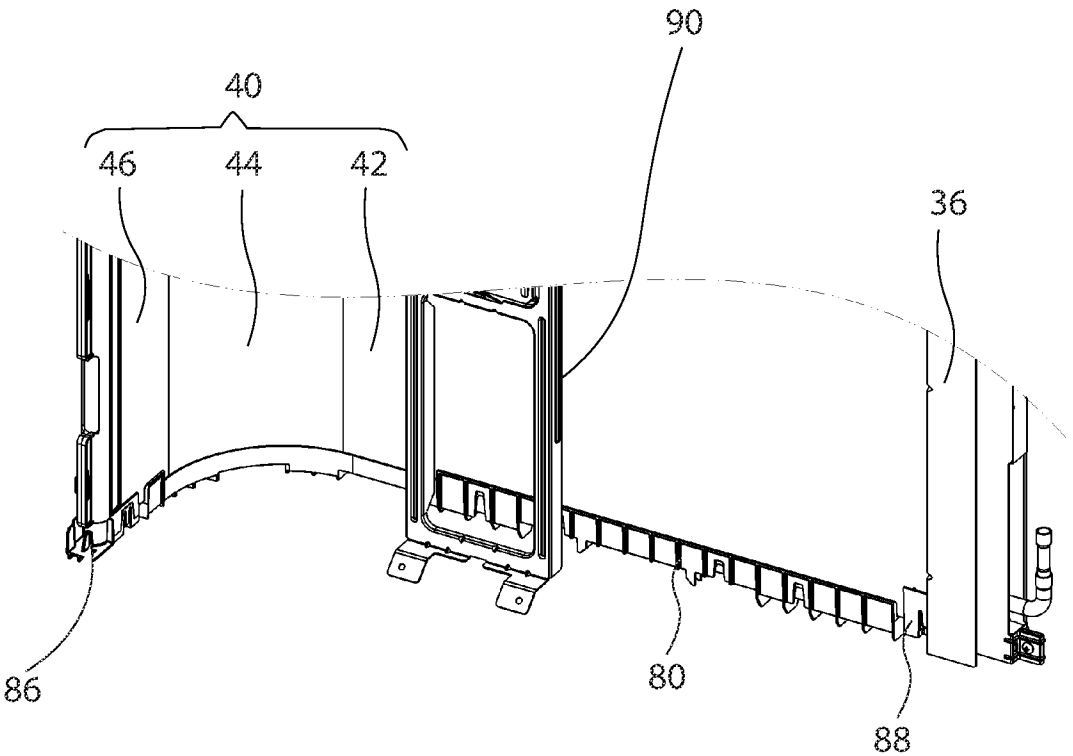
FIG. 5 is an explanatory view of the lower support 80 which is not contact with the fan motor support.

As shown in FIG. 4 to FIG. 5, a first end lower support 86, a lower support 80 and a second end lower support 88 are attached to the bottom of the heat exchanger 40. The first end lower support 86, the lower support 80 and the second end lower support 88 are made of synthetic resin. The first end lower support 86 is attached to the heat exchanger 40 so as to cover the end of the side surface portion 46 of the heat exchanger 40 from beneath. The second end lower support 88 is attached to the heat exchanger 40 so as to cover the end of the front surface portion 42 of the heat exchanger 40 from beneath. The lower support 80 is attached to the heat exchanger 40 so as to continuously cover the front surface portion 42, the corner portion 44 and the side surface portion 46 when viewed from below.

As shown in FIG. 2 to FIG. 5, the second end upper support 76 and the second end lower support 88 are fitted into the connection member 36, and both are fastened by a screw (not shown). The first end upper support 74 and the first end lower support 86, as well as the second end upper support 76 and the second end lower support 88, as well as the second end upper support 76 and the second end lower support 88 may be formed in the same shape respectively. The details about the upper support 50 and the lower support 80 will be described later.

The fan motor 26 is fixed to a fan motor support member 90 locked to the upper support 50 of the heat exchanger 40. The fan motor support member 90 has a bottom portion fixed to the bottom plate 10, and is positioned between the propeller fan (air-sending fan) 30 and the heat exchanger 40 in the frontward-and-backward direction. The fan motor support member 90 is configured to support not only the fan motor 26 but also the air-sending fan 30 connected to the rotary shaft 28 of the fan motor 26. The fan motor support member 90 is made of sheet metal, and is integrally molded.

When the fan motor 26 is driven by power supply, the propeller fan rotates. At this time, air is sucked from the rear surfaces of the front surface portion 42, the corner portion 44, and the side surface portion 46 of the heat exchanger 40, and sucked air is sent from the surface of the heat exchanger 40 into the blower chamber 20. The fed air is discharged forward from the front panel 12. During cooling operation, the refrigerant in the heat exchanger 40 is cooled by air, and the air that has passed through the heat exchanger 40 is heated by heat exchange with the refrigerant.

Moreover, in order to assemble the components, firstly, the first end lower support 86, the second end lower support 88 and the lower support 80 are attached to the lower end of the heat exchanger 40, as well as the first end upper support 74, the second end upper support 76 and the upper support 50 are attached to the upper end of the heat exchanger 40.

Secondly, the second end upper support 76 and the second end lower support 88 are fitted into the connection member 36 and fastened by a screw (not shown). Next, the first end lower support 86 is attached to the lower end of the side surface portion 46 of the heat exchanger 40, and the first end upper support 74 is attached to the upper end of the side surface portion 46.

Thereafter, the heat exchanger 40 is installed and fixed on the bottom plate 10, and the compressor 32 is fixed on the bottom plate 10, and the refrigerant pipes 34 connected to the compressor 32 are connected to the heat exchanger 40. The fan motor support member 90 is locked and fixed to the upper support 50. Namely, the lower end of the fan motor support member 90 is not fixed to the heat exchanger 40.

Then, the fan motor 26 is fixed to the fan motor support member 90, and the propeller fan 30 is mounted on the fan motor 26, and the separator 24 is attached to the connection member 36.

Finally, the front panel 12 and the side panel 14 are attached to the bottom plate 10, and the top plate 18 is attached to the front panel 12 and the side panel 14 to cover the top of the outdoor unit 100.

Next, the configurations of the upper support 50 and the lower support 80 will be described with reference to FIG. 2 to FIG. 11.

As shown in FIG. 2 to FIG. 3 and FIG. 6 to FIG. 11, the upper support 50 is the member which continuously covers the front surface portion 42, the corner portion 44 and the side surface portion 46 when viewed from above, and which includes a groove 58 opening downward so that a top portion of the heat exchanger 40 fits to the groove 58 of the upper support 50. The upper support 50 includes a pair of side plates 60, 60 which so that the groove 58 is formed between the side plates 60, 60.

The upper support 50 includes an upper support front portion 52 which covers the front surface portion 42, an upper support corner portion 54 which covers the corner portion 44, and an upper support side portion 56 which covers the side surface portion 46, when viewed from above.

The upper support 50 is formed in an L-shape when viewed from above so that a length in the longitudinal direction of the upper support front portion 52 is made longer than that of the upper support side portion 56 when viewed from above. A width of the upper support corner portion 54 is made wider than that of the upper support front portion 52 when viewed from above.

As shown in FIG. 2, FIG. 3, FIG. 8 and FIG. 11, the side plates 60, 60 of the upper support 50 are plate members which have elasticity and are formed to extend along a direction in which the heat exchange extends when the upper support 50 is attached to the heat exchanger 40. As such, since the upper support 50 includes a groove 58 opening downward so that a top portion of the heat exchanger 40 fits to the groove 58 of the upper support 50, the upper support 50 can be easily attached on the heat exchanger 40.

In this embodiment, a groove width of the upper support corner portion 54 is made wider than that of the upper support front portion 52. As such, it is possible to surely and easily attach the upper support 50 to the heat exchanger 40.

Moreover, the side plate 60 has a plural of notches 62 and a plural of plate walls in the side plate 60 is formed between notches 62, mainly to increase the volume of air which flows into the heat exchanger 40.

Figure 6:
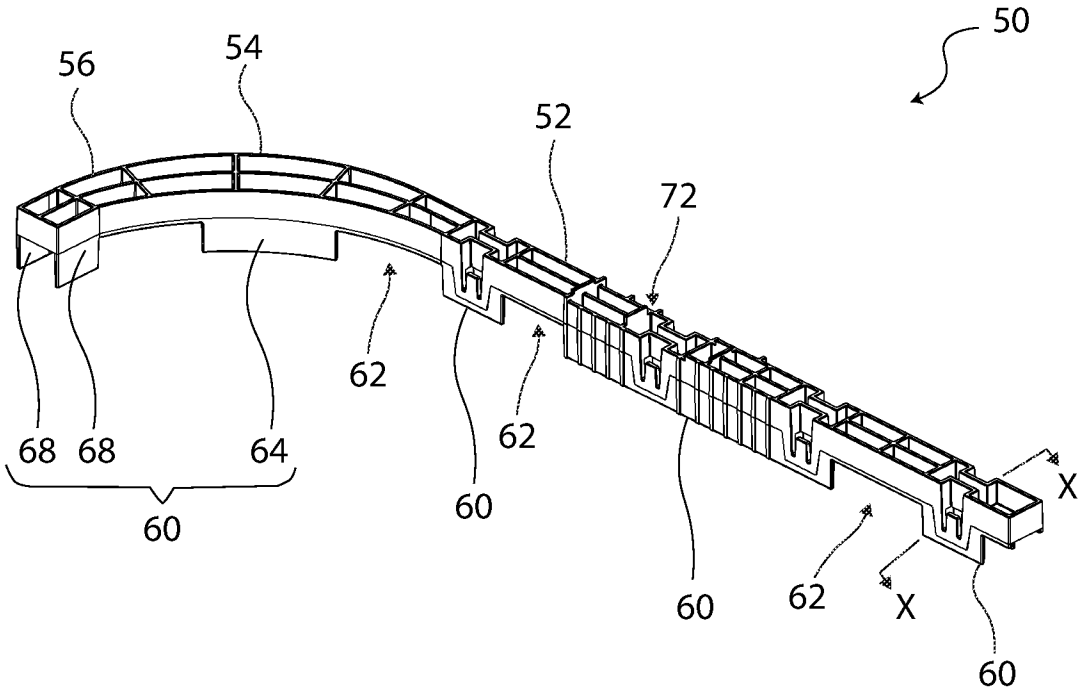
FIG. 6 is a perspective view of the upper support 50, illustrated in FIG. 1.
Figure 7:
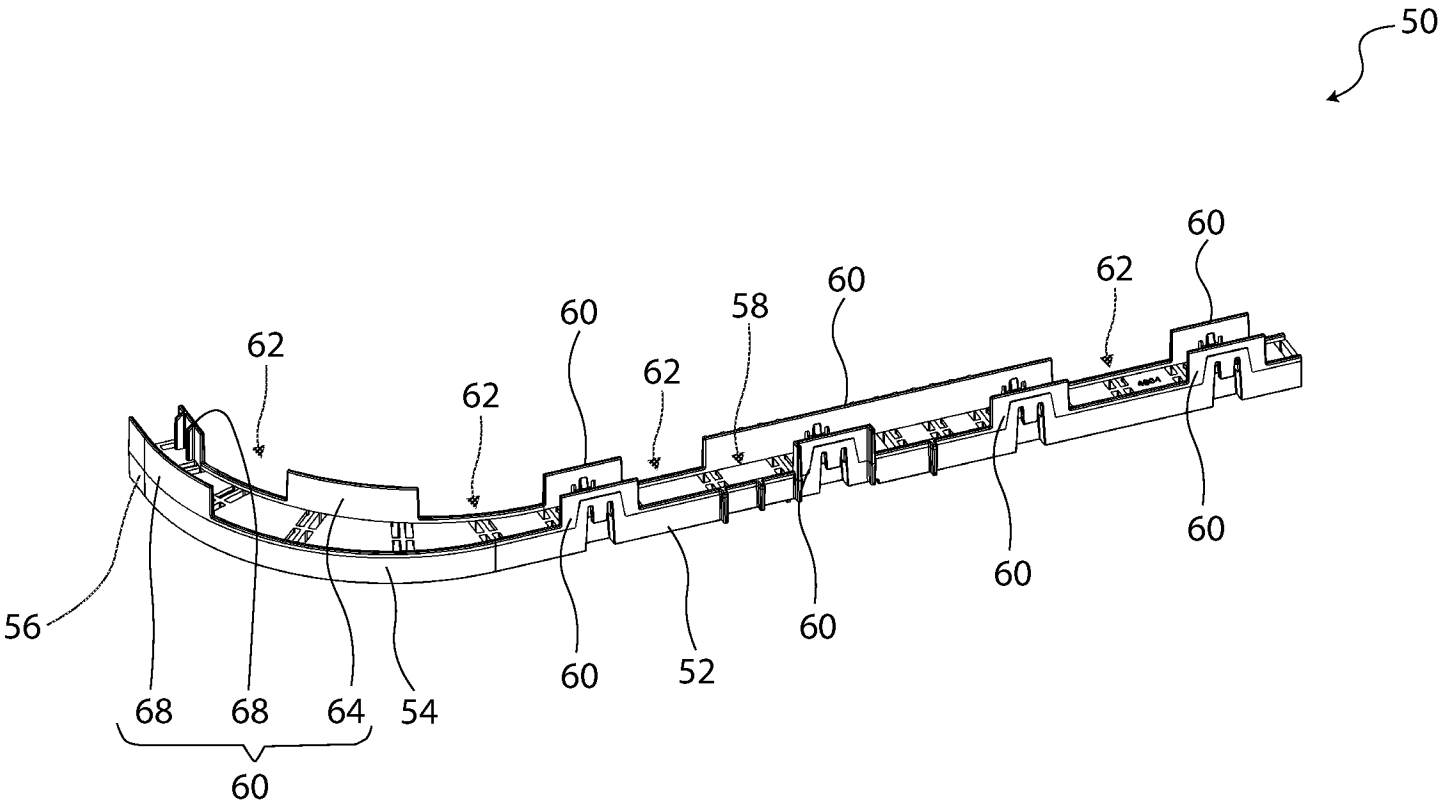
FIG. 7 is a perspective view of the upper support 50 when viewed from below, illustrated in FIG. 1.
Figure 8A:
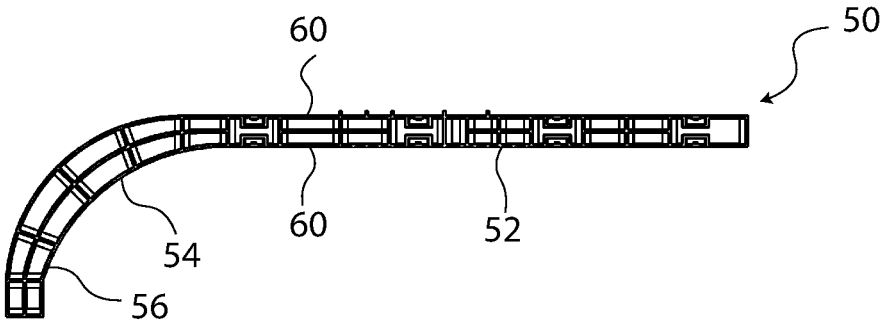
FIG. 8A is a top view of the upper support 50.
Figure 8B:
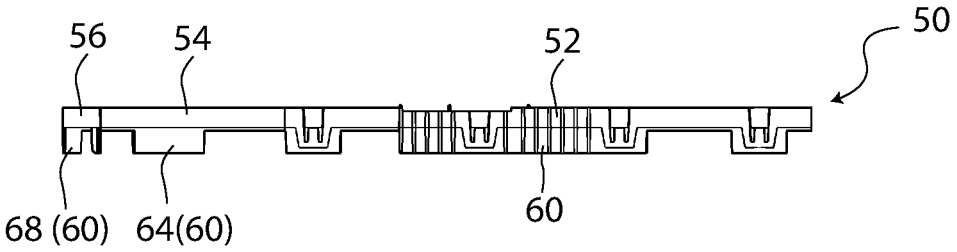
FIG. 8B is side view of the upper support 50.
Figure 8C:
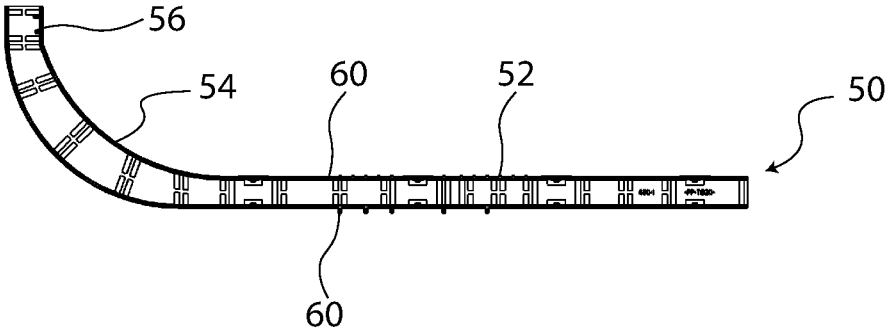
FIG. 8C is a bottom view of the upper support 50.
Figure 9:
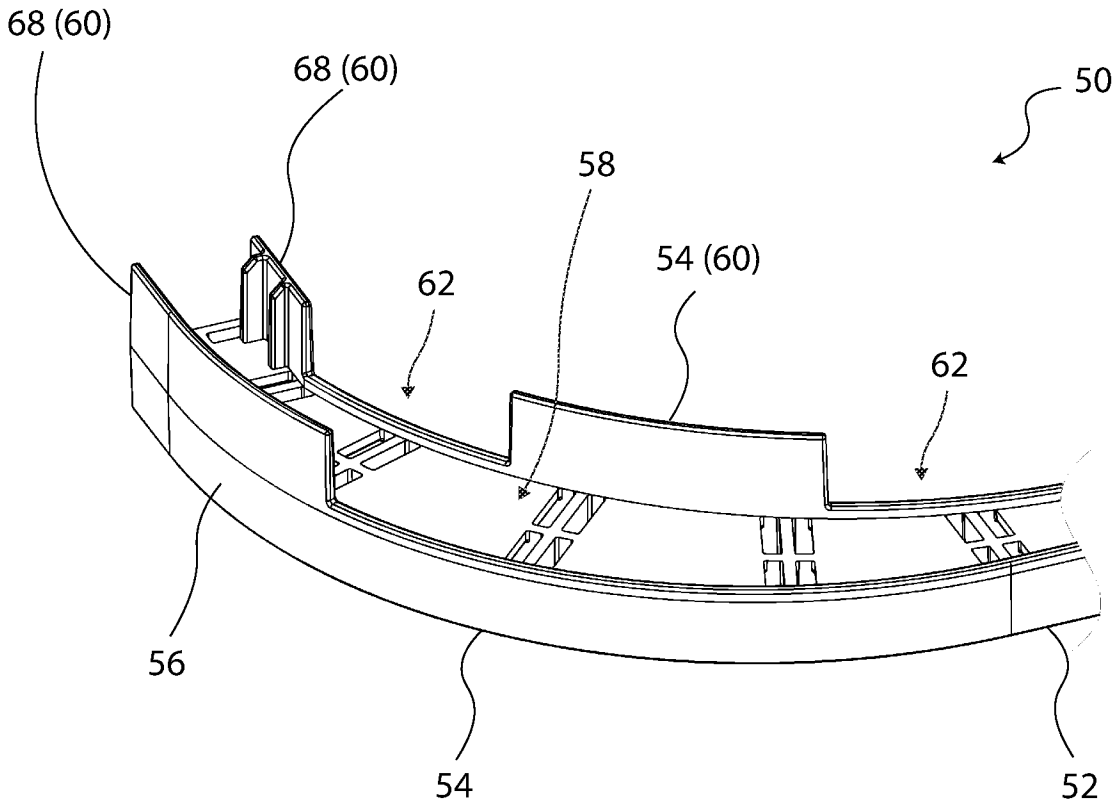
FIG. 9 is an enlarged view of the upper support 50 corner portion of the upper support 50, illustrated in FIG. 7.

As shown in FIG. 6, FIG. 7 and FIG. 9, the upper support corner portion 54 include a first corner wall 64 which is included in the side plate 60 and faces the inside of the outdoor unit 100, and the upper support side portion 56 include a side wall 68 which is included in the side plate 60 and faces the outside of the outdoor unit 100. Since the first corner wall 64 and the side wall 68 function as guide walls when the upper support 50 is attached to the heat exchanger 40, it is possible to more easily attach the upper support 50 to the heat exchanger 40.

Although not shown in a figure, it is preferable that the upper support corner portion 54 further includes a second corner wall 66 which is included in the side plate 60 and faces the outside of the outdoor unit 100, and the first corner wall 64 and the second corner wall 66 are oppositely disposed by interposing the groove 58. Since the first corner wall 64 and the second corner wall 66 function as guide walls for the upper support corner portion 54 when the upper support 50 is attached to the heat exchanger 40, it is possible to furthermore surely and easily attach the upper support 50 to the heat exchanger 40.

As shown in FIG. 7 and FIG. 9, the side plate 60 of the upper support 50 includes hook members 70 with a convex structure inside the groove 58, and the hook member 70 is hooked to the heat exchanger 40. In this embodiment, the hook members 70 are hooked to the front surface portion 42 and side surface portion 46 of the heat exchanger 40. Since the upper support 50 hooks at least two points of the heat exchanger 40 by the hook members 70, the upper support 50 can be firmly fixed to the heat exchanger 40.

In this embodiment, since the side plate 60 has a plural of notches 62 and the plate walls including the first corner wall 64 and the second corner wall 66, in the side plate 60, is formed between notches 62. As such, it is not only to increase the volume of air which flows into the heat exchanger 40, but also to firmly fix the upper support 50 to the heat exchanger 40. As a result, it is possible to effectively improve heat exchanger 40 effectiveness by a simple and compact composition.

Figure 10:
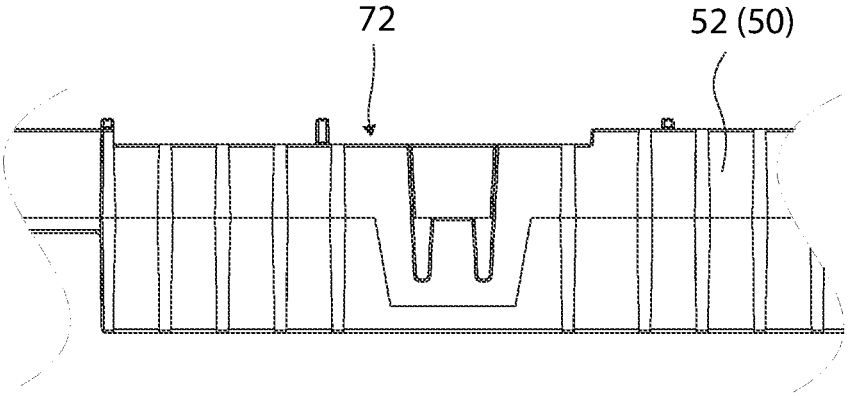
FIG. 10 is an enlarged view of the hook which is located in a groove 58 of the upper support 50, illustrated in FIG. 7.
Figure 11:
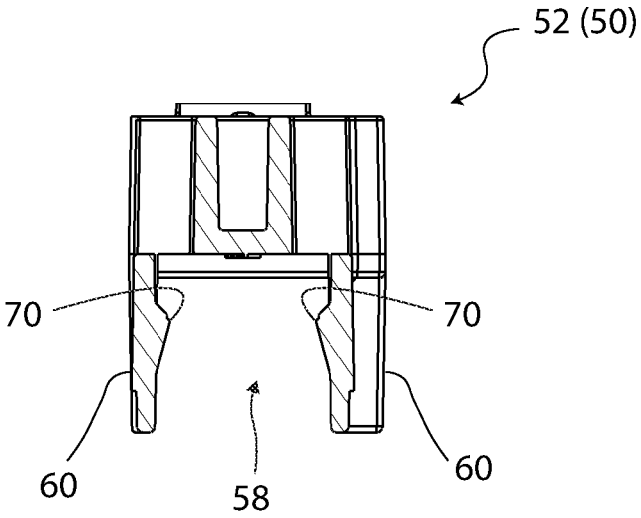
FIG. 11 is an end view of the upper support 50 including the hook, taken along line X-X of FIG. 6.

As shown in FIG. 6 and FIG. 10, the upper support 50 includes a recess portion 72 which is formed to engage the fan motor support member 90. As such, the fan motor support member 90 can be firmly fixed to the upper support 50. Moreover, since the upper support 50 is made of synthetic resin and functions as an insulating member, it is possible to surely and easily prevent the electrolytic corrosion in the heat exchanger 40.

As shown in FIG. 4 and FIG. 5, the lower support 80 is the member which is formed in a symmetrical shape across the heat exchanger 40. The lower support 80 continuously covers the front surface portion 42, the corner portion 44 and the side surface portion 46 when viewed from below, and which includes a groove 82 opening upward so that a bottom portion of the heat exchanger 40 fits to the groove 82 of the lower support 80. The lower support 80 includes a pair of side plates 84, 84 which so that the groove 82 is formed between the side plates 84, 84. The lower support 80 does not include any notches 62, but is not limited to this.

Moreover, the side plate 84 of the lower support 80 includes hook members 70 with a convex structure inside the groove 82, and the hook member 70 is hooked to the heat exchanger 40. In this embodiment, the hook members 70 are hooked to the front surface portion 42 and side surface portion 46 of the heat exchanger 40. Since the lower support 80 hook at least two points of the heat exchanger 40 by the hook members 70, the lower support 80 can be firmly fixed to the heat exchanger 40.

The lower support 80 which continuously covers the front surface portion 42, the corner portion 44 and the side surface portion 46 when viewed from below, even if the heat exchangers 40 are stacked up and thereby the perpendicular downward load generated by the stacked heat exchangers 40 on the lower support 80, is applied on the lower support 80, the load can be distributed on the whole lower support 80 which is positioned on the bottom of the front surface portion 42, the corner portion 44 and the side surface portion 46. As such, the lower support 80 can bear a heavy load.

As a result, it is possible to prevent the heat exchanger 40 from being locally deformed by the perpendicular downward load which is applied on the lower support 80 in case that the heat exchangers 40 are stacked up.

As shown in FIG. 3 and FIG. 5, the fan motor support member 90 is made of, for example, a steel plate. The fan motor support member 90 is formed in a rectangular shape extending in the vertical direction of the heat exchanger 40, and a fan motor 26 is fixed to a central portion thereof. An engaging portion 92 including a groove opening downward so as to engage with the recess portion 72 of the upper support 50 is provided at an upper end of the fan motor support member 90.

For the purpose of preventing damages to the heat exchanger 40, the fan motor support member 90 is formed so as not to contact the heat exchanger 40 (See FIG. 3 and FIG. 5). Additionally, a spacer which extends toward the front surface portion 42 of the heat exchanger 40 and is bent upward at right angles, may be provided at the center of the lower end of the fan motor support member 90. Since the spacer contacts with the front surface portion 42 of the heat exchanger 40 and keep the space between the fan support member and the heat exchanger 40, it is possible to prevent damages to the heat exchanger 40 due to contact of the fan support member and the heat exchanger 40.

According to this embodiment, firstly, since the upper support 50 which continuously covers the front surface portion 42, the corner portion 44 and the side surface portion 46 when viewed from above, the upper support 50 functions as the cover which is formed to cover the top of the heat exchanger 40. As such, even if the rainwater and/or the drain water flows into the heat exchanger 40, it is possible to reduce the opportunities to bring the rainwater and/or the drain water into contact with the heat exchanger 40. Therefore, it is possible to prevent the electrolytic corrosion in the heat exchanger 40.

Secondly, an upper support 50 which continuously covers the front surface portion 42, the corner portion 44 and the side surface portion 46 when viewed from above, even if the heat exchangers 40 are stacked up and thereby the perpendicular downward load generated by the stacked heat exchangers 40 on the upper support 50, is applied on the upper support 50, the load can be distributed on the whole upper support 50 which is positioned on the top of the front surface portion 42, the corner portion 44 and the side surface portion 46. As such, the upper support 50 can bear a heavy load.

As a result, it is possible to prevent the heat exchanger 40 from being locally deformed by the perpendicular downward load which is applied on the upper support 50 in case that the heat exchangers 40 are stacked up.

Therefore, according to the embodiment, it is possible to prevent the heat exchanger 40 from being locally deformed by the perpendicular downward load which is applied on the upper support 50 in case that the heat exchangers 40 are stacked up, as well as to prevent the electrolytic corrosion in the heat exchanger 40.

In another embodiment, in case that the notches are not formed in the side plates 60, 60 of the upper support 50, it is possible to form a pair of hook members inside the groove 58, which are continuously formed to extend along a longitudinal direction of the upper support 50. According to the embodiment, it is possible to improve rigidity of the upper support 50 and the upper support 50 is more firmly fixed to the heat exchanger 40.

Although specific embodiments of the invention have been disclosed and described as well as illustrated in the companying drawings, it is simply for the purpose of better understanding of the principle of the present invention and it is not as a limitation of the scope and spirit of the teaching of the present invention. Adaption and modification to various structures such as design or material of the invention are possible and apparent to a skilled person without departing from the scope of the present invention which is to be determined by the claims.

LIST OF REFERENCE

100: outdoor unit
10: bottom plate
12: front panel
14: side panel
16: leg
18: top plate
20: blower chamber
22: machine chamber
24: separator
26: fan motor
28: rotary shaft
30: propeller fan (air-sending fan)
32: compressor
34: refrigerant pipe
36: connection member
40: parallel flow type heat exchanger (heat exchanger)
42: front surface portion
44: corner portion
46: side surface portion
50: upper support
52: upper support front portion
54: upper support corner portion
56: upper support side portion
58: groove
60: side plate
62: notch
64: first corner wall
66: second corner wall
68 side wall
70: hook member
72: recess portion
74: first end upper support
76: second end upper support
80: lower support
82: groove
84: side plate
86: first end lower support
88: second end lower support
90: fan motor support member
92: engaging portion

The invention claimed is:

1. An outdoor unit for an air-conditioning apparatus, comprising:

a bottom plate made of metal;

a heat exchanger made of metal that is different from metal of the bottom plate, which includes a front surface portion, a corner portion bent from one end of the front surface portion toward the front side and a side surface portion extending further toward the front side from the corner portion, and which is formed in an L-shape when viewed from above so that a length in the longitudinal direction of the front surface portion is made longer than that of the side surface portion when viewed from above, and which is installed on the bottom plate so that surfaces of the front surface portion, the corner portion and the side surface portion, into which air flows, face outward; and an upper support which continuously covers the front surface portion, the corner portion and the side surface portion when viewed from above, which includes a groove opening downward so that a top portion of the heat exchanger fits to the groove of the upper support;

wherein the corner portion is curved, wherein the upper support includes an upper support front portion which covers the front surface portion, an upper support corner portion which covers the corner portion, and an upper support side portion which covers the side surface portion, wherein the upper support corner portion is curved, and wherein a width of the upper support corner portion is made wider than that of the upper support front portion when viewed from above.

2. The outdoor unit for an air-conditioning apparatus of claim 1, wherein the upper support includes hook members inside the groove, and wherein the hook members are hooked to the front surface portion and side surface portion.

3. The outdoor unit for an air-conditioning apparatus of claim 2, wherein the hook member includes a plurality of hooks which are formed to be separate from each other.

4. The outdoor unit for an air-conditioning apparatus of claim 1, wherein the upper support includes a pair of side plates so that the groove is formed between the side plates, wherein the upper support corner portion include a first corner wall which is included in the side plate and faces the inside of the outdoor unit, and wherein the upper support side portion include a side wall which is included in the side plate and faces the outside of the outdoor unit.

5. The outdoor unit for an air-conditioning apparatus of claim 4, wherein a groove width of the upper support corner portion is made wider than that of the upper support front portion.

6. The outdoor unit for an air-conditioning apparatus of claim 5, wherein the upper support corner portion further includes a second corner wall which is included in the side plate and faces the outside of the outdoor unit, and wherein the first corner wall and the second corner wall are oppositely disposed by interposing the groove.

7. The outdoor unit for an air-conditioning apparatus of claim 1, wherein the outdoor unit further includes a fan motor support to which a fan motor is fixed, and wherein the upper support includes a recess portion which is formed to engage the fan motor support.

8. The outdoor unit for an air-conditioning apparatus of claim 1, wherein the heat exchanger is made of aluminum or aluminum alloy.

* * * * *